United States Patent [19]

Sengupta et al.

[11] Patent Number: 4,807,454

[45] Date of Patent: Feb. 28, 1989

[54] MEANS FOR LOCKING A DISPLACEABLE OR ROTATABLE PART

[75] Inventors: Pritimay Sengupta; Ewald Kornmayer, both of Berlin, Fed. Rep. of Germany

[73] Assignee: Zeiss Ikon AG, Fed. Rep. of Germany

[21] Appl. No.: 182,513

[22] Filed: Apr. 18, 1988

[30] Foreign Application Priority Data

Apr. 21, 1987 [DE] Fed. Rep. of Germany ..... 3713653

[51] Int. Cl.[4] ..... E05B 47/00

[52] U.S. Cl. ..... 70/277; 70/386; 70/DIG. 62

[58] Field of Search ..... 70/277, 278, 280, 282, 70/386, 493, 378, DIG. 62

[56] References Cited

U.S. PATENT DOCUMENTS

| | | | |
|---|---|---|---|
| 3,525,242 | 8/1970 | Young | 70/386 |
| 3,670,538 | 6/1972 | Curry | 70/277 |
| 4,250,725 | 2/1981 | Prunbauer | 70/386 |
| 4,603,564 | 8/1986 | Kleinhany | 70/277 |

*Primary Examiner*—Robert L. Wolfe

[57] ABSTRACT

Locking means for preventing displacement of a displaceable member relative to a stationary member by means of an armature operatively associated with an electromagnet, the armature having a bipartite structure: a locking pin member engageable with the displaceable member and a sleeve member coaxially surrounding the locking pin member located on an end of an armature extending from the electromagnet. A plurality of radially mobile balls interact within bores in a portion of the stationary member extending between the locking pin member and the sleeve member to engage grooves in the locking pin member to lock or secure same in a position in which the locking pin member is engaged with the displaceable member. Selective energization of the electromagnet selectively positions the sleeve member and a groove located within an interior wall of the sleeve member to selectively limit radial movement of the balls. In a deenergized state, the electromagnet permits axial displacement of the locking pin member.

15 Claims, 1 Drawing Sheet

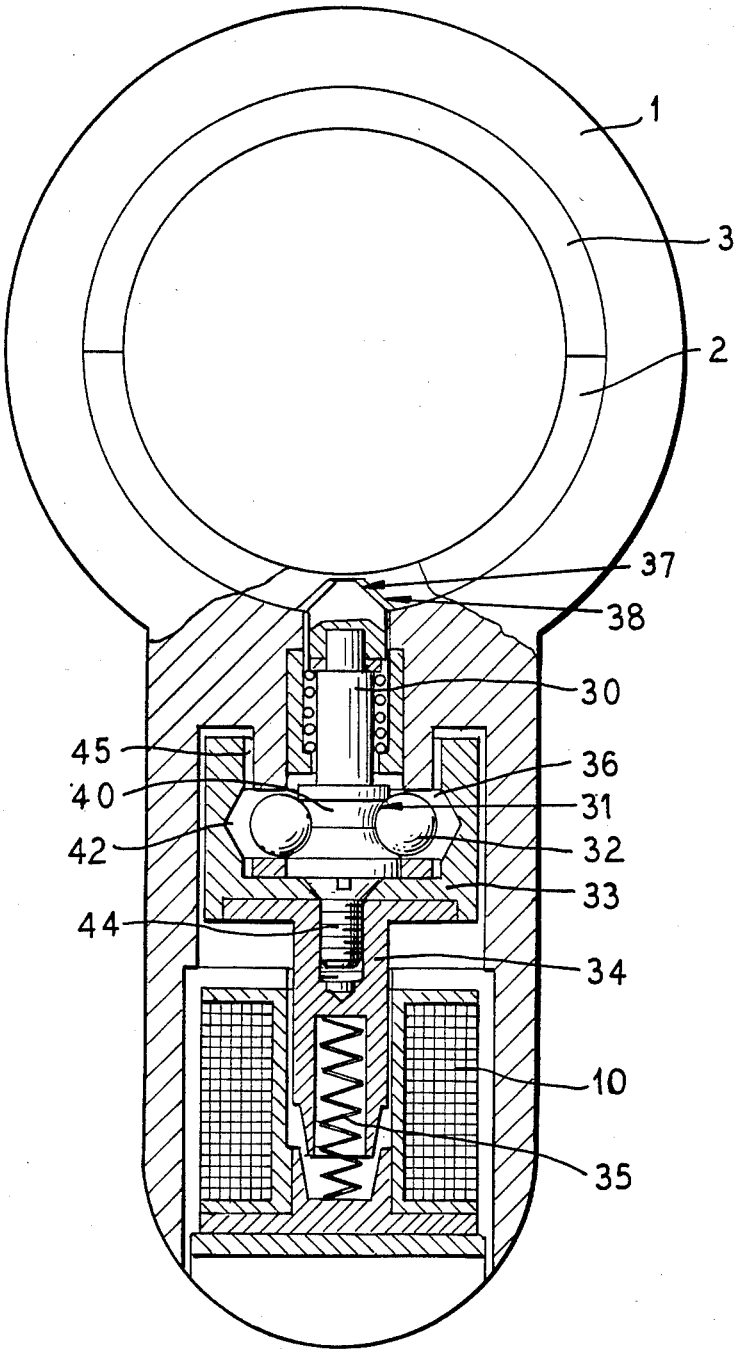
1
3
2
37
38
30
45
36
40
31
42
32
33
44
34
10
35

MEANS FOR LOCKING A DISPLACEABLE OR ROTATABLE PART

BACKGROUND OF THE INVENTION

1. Field of the Invention

The invention is directed generally to locking means for preventing displacement of a displaceable member relative to a stationary member by means of a cooperating electromagnet and armature and, specifically, to locking means for preventing rotation of a lock cylinder.

2. Discussion of the Related Art

It is known to use an electromagnet in the form of a solenoid to actuate an armature operatively associated with the solenoid. The armature can be caused to be attracted into the electromagnet upon energization of the electromagnet. An extended armature can be used to prevent displacement of a displaceable member by locking or securing same relative to a stationary member.

SUMMARY OF THE INVENTION

The invention includes locking means for preventing displacement of a displaceable member relative to a stationary member using:

(a) an electromagnet;

(b) an armature operatively associated with the electromagnet, the armature being attractable into the electromagnet upon energization of the electromagnet;

(c) a locking pin number engageable with the displacement member to prevent displacement of the displaceable member;

(d) a sleeve member coaxially surrounding the locking pin member and located on an end of the armature extending from the electromagnet;

(e) a groove circumferentially surrounding the locking pin member; and (f) a plurality of balls located within bores in the stationary member radially moveable between the grooves surrounding the locking pin member and an interior wall of the sleeve member, the radial movement of the balls being selectively limited by the selective positioning of the sleeve member.

In accordance with the principles of the invention, the invention can be thought of as including an armature having a bipartite structure comprising the locking pin member and the combination of the sleeve member and the armature. This bipartite structure is advantageous in that only the combination of the sleeve member and the armature is moved by the electromagnet and that the combination of the sleeve member and the armature is not in engagement with the displaceable member, this being carried out by the locking pin member. Furthermore, the locking pin member is fashioned in a conical configuration and engages correspondingly conically-shaped stop faces provided at the displaceable member. Independent displacement of the locking pin member can be achieved on the basis of the interaction of the conically-shaped surfaces upon displacement of the displaceable member without the electromagnet armature becoming actuated.

The locking function in the invention is achieved through the radial mobility of the balls and on the relative movement between the locking pin member and the sleeve member.

The locking means of the present invention can be utilized inside a cylinder lock in order to prevent the turning of a core. It is possible to control the electromagnet via electronic signals that, for example, respond to codings in a key. The lock core is be surrounded by half shells that are rotatable displaceable members and are coupled thereto or to the locking beard so that rotation is selectively prevented by using the locking means of the invention.

BRIEF DESCRIPTION OF THE DRAWINGS

The FIGURE is a cross-sectional view, partially broken away, of a locking mechanism embodying principles of the invention.

DETAILED DESCRIPTION OF THE PREFERRED EMBODIMENT

Shown in the FIGURE is a device embodying principles of the invention including locking means for preventing displacement of a displaceable member relative to a stationary member. The invention is adaptable through a wide variety of uses and in the FIGURE there is shown just one such use.

In the FIGURE, the displaceable member comprises the rotatable half shells or rings 2 and 3 which, together, rotate within the stationary member 1. The rotation of the half shells 2 and 3 is limited by a locking pin member 30 which has a conically-shaped head portion 37 which projects into a similarly conically-shaped cut-out with stop faces 38 in the half shell 2. Thus, the locking pin member 30, engages the displaceable member through the half shell 2 to prevent its rotation relative to the stationary member 1.

The locking pin member 30 includes a base member 40 having a circumferential groove 31. Coaxially surrounding the base member 40 is a cylindrically-shaped sleeve member 33 having a groove 42 ringing an interior wall thereof.

A plurality of balls 32 are located within stationary member bores 36 between the grooves 31 and 42. The balls 32 are radially mobile within the bores 36 to the extent permitted by the groove 42 and that is to say, if the groove 42 was not present, the balls 32 would have no or little mobility. The function of the balls 32 is discussed in detail below.

The sleeve member 33 is mounted onto an armature 34 by means of a screw 44. In the preferred embodiment, the sleeve member 33 and armature 34 are constructed separately, however, it is possible to form them as an integral unit.

The armature 34 is operatively associated with an electromagnet coil 10 as is well-known in the solenoid art. A spring 35 serves as a pre-stressed loading means to bias the armature outward from the center of electromagnet coil 10.

As is shown in the FIGURE, the spring 35 normally biases the armature outward from electromagnet coil 10 against the base 40 of the locking pin member 30 to thereby bias the locking pin member 30 into engagement with the rotatable half shell 2. Rotation of the half shells 2 and 3 however, will cause the stop faces 38 to engage the conically-shaped head portion 37 of the locking pin member 30 and, due to the interaction of the surfaces, cause the locking pin member to move axially against the bias of the spring 35. Eventually, the bias of the spring 35 can be overcome and the half shells 2 and 3 are free to rotate within stationary member 1. Thus, when the electromagnet coil 10 is not energized, the locking pin member 30 is free to move axially and the displaceable member comprising the half shells 2 and 3 is free to be displaced or rotate relative to the stationary member 1.

As can be further seen in the FIGURE, when the electromagnet coil 10 is in an unenergized state, the balls 32 are permitted the greatest amount of radial movement because the sleeve member 33 is positioned such that the groove 31 of the locking pin member 30 and the groove 42 of the sleeve member 33 are in alignment creating a long space within which the balls 32 may move. However, when the electromagnet coil 10 is energized, the armature 34 will be attracted into the electromagnet coil 10 pulling the sleeve member 33 axially downward into a retracted position. In the retracted position, the groove 42 will be positioned below the base member 40 of the locking pin member 30 and the balls 32 will no longer have the same length of space within which to move within the bores 36. Instead, the radial movement of the balls 32 will be limited by the upper wall portion 45 of the sleeve member 33.

When the radial movement of the balls 32 is limited, the balls 32 project into the groove 31 of the locking pin member 30. By projecting into the groove 31 of the locking pin member 30 the balls 32 prevent the locking pin member 30 from being displaced axially. Thus, the locking pin member 30 will be in engagement with the rotatable half shell 32 and prevent its rotation.

The embodiment shown in the FIGURE is especially adaptable for use in a lock cylinder. The half shells 2 and 3 surround a core of the lock cylinder and are coupled thereto selectively. Power to the electromagnet coil 10 is controlled by electronic circuitry responsive to codings so that the lock cylinder core could not be turned unless the coding is matched by a key.

Additionally, although only a rotatable member which rotates relative to a stationary member has been shown in the FIGURE, the invention is equally applicable to an axially displaceable member. It should be easily apparent to those skilled in the art how to include an appropriate engagement cut-out in an axially displaceable member so that the invention can be adapted to selectively prevent axial displacement of the displaceable member.

While a preferred embodiment has been shown, modifications and changes may become apparent to those skilled in the art which shall fall within the spirit and scope of the invention. It is intended that such modifications and changes be covered by the attached claims.

We claim:

1. Locking means for preventing displacement of a displaceable member relative to a stationary member, comprising:

(a) electromagnet;

(b) an armature operatively associated with said electromagnet, said armature being retractable into said electromagnet upon energization of said electromagnet;

(c) a locking pin member located within said stationary member engageable with said displaceable member to prevent displacement of said displaceable member;

(d) a sleeve member coaxially surrounding said locking pin member and located on an end of said armature extending from said electromagnet;

(e) a groove circumferentially surrounding said locking pin member; and (f) a plurality of balls located within bores in said stationary member radially movable between said grooves surrounding said locking pin member and an interior wall of said sleeve member, said radial movement of said balls being selectively limited by selective positioning of said sleeve member.

2. Locking means for preventing displacement of a displaceable member relative to a stationary member as set forth in claim 1, wherein said interior wall of said sleeve member includes a groove which is selectively alignable with said bores by said energization of said electromagnet.

3. Locking means for preventing displacement of a displaceable member relative to a stationary member as set forth in claim 2, further including means for biasing said armature outward from said electromagnet.

4. Locking means for preventing displacement of a displaceable member relative to a stationary member as set forth in claim 1, wherein said bores in said stationary member are located in a portion of said stationary member which surrounds said locking pin member and extends into said sleeve member.

5. Locking means for preventing displacement of a displaceable member relative to a stationary member as set forth in claim 1, wherein said locking pin member includes a conically-shaped head portion which engages a correspondingly conically-shaped recess in said displaceable member, displacement of said displaceable member causing axial displacement of said locking pin member from said displaceable member but energization of said electromagnet preventing such axial displacement.

6. Locking means for preventing displacement of a displaceable member relative to a stationary member as set forth in claim 2, wherein said locking pin member includes a conically-shaped head portion which engages a correspondingly conically-shaped recess in said displaceable member, displacement of said displaceable member causing axial displacement of said locking pin member from said displaceable member but energization of said electromagnet preventing such axial displacement.

7. Locking means for preventing rotation of a rotatable lock cylinder core relative to a lock housing, comprising:

(a) half shells surrounding said core and coupled thereto for rotation therewith;

(b) an electromagnet;

(c) an armature operatively associated with said electromagnet, said armature being retractable into said electromagnet upon energization of said electromagnet;

(d) a locking pin member located with the lock housing engageable with one of said half shells to prevent rotation of said half shells;

(e) a sleeve member coaxially surrounding said locking pin member and located on an end of said armature extending from said electromagnet;

(f) a groove circumferentially surrounding said locking pin member; and (g) a plurality of balls located within bores in said lock housing radially movable between said grooves surrounding said locking pin member and an interior wall of said sleeve member, said radial movement of said balls being selectively limited by selective positioning of said sleeve member.

8. Locking means for preventing rotation of a rotatable lock cylinder core relative to a lock housing as set forth in claim 7, wherein said interior wall of said sleeve member includes a groove which is selectively alignable with said bores by said energization of said electromagnet.

9. Locking means for preventing rotation of a rotatable lock cylinder core relative to a lock housing as set forth in claim 8, further including means for biasing said armature outward from said electromagnet.

10. Locking means for preventing rotation of a rotatable lock cylinder core relative to a lock housing as set forth in claim 7, wherein said bores in said lock housing are located in a portion of said lock housing which surrounds said locking pin member and extends into said sleeve member.

11. Locking means for preventing rotation of a rotatable lock cylinder core relative to a lock housing as set forth in claim 7, wherein said locking pin member includes a conically-shaped head portion which engages a correspondingly conically-shaped recess in said engaged half shell, rotation of said half shells causing axial displacement of said locking pin member from said half shells but energization of said electromagnet preventing such axial displacement.

12. Locking means for preventing rotation of a rotatable lock cylinder core relative to a lock housing as set forth in claim 8, wherein said locking pin member includes a conically-shaped head portion which engages a correspondingly conically-shaped recess in said engaged half shell, rotation of said half shells causing axial displacement of said locking pin member from said half shells but energization of said electromagnet preventing such axial displacement.

13. In a locking means of the type for locking a part which is movably displaceable by means of an electromagnet, the improvement of:

a locking pin having a first circumferential groove adapted to receive a plurality of balls, a cup-shaped retainer sleeve coaxially confining said locking pin and having a second circumferential groove complementary to the shape of the balls, the radial mobility of the balls being a function of the axial position of the sleeve with the first and second circumferential grooves, and relatively displaceable parts keyed to said locking pin, whereby the displacement of the parts is a function of the displacement of the pin in an axial direction which is permitted only when the balls are movable radially in the registered circumferential grooves.

14. In a lock, nested rotatable rings journaled in a stationary member and having a notched cut-out with stop faces:

a lock pin received in said notched cut-out and engageable with said stop faces to lock said rings against displacement, said lock pin having a body member, a sleeve concentrically disposed relative to said body member, first and second circumferential grooves formed in said body member and said sleeve, a plurality of balls radially mobile in said grooves when in register with one another, and actuating means to selectively move said locking pin into and out of engagement with said stop faces when permitted so to move by the position of said balls in said grooves.

15. In a lock as defined in claim 14, wherein said actuating means comprises an electromagnet for selectively moving the sleeve in unison with the armature of the electromagnet.

* * * * *